US005758690A

United States Patent [19]

Humpert et al.

[11] Patent Number: 5,758,690

[45] Date of Patent: Jun. 2, 1998

[54] HOSE-TYPE PULL-OUT FAUCET

[75] Inventors: Jürgen Humpert, Hemer; Eckhard Gransow, Fröndenberg; Bernd Bischoff, Hemer, all of Germany

[73] Assignee: Friedrich Grohe AG, Hemer, Germany

[21] Appl. No.: 677,393

[22] Filed: Jul. 9, 1996

[30] Foreign Application Priority Data

Jul. 26, 1995 [DE] Germany ..... 195 27 232.3

[51] Int. Cl.[6] ..... E03C 1/02

[52] U.S. Cl. ..... 137/801; 4/678; 239/447; 239/449; 239/588

[58] Field of Search ..... 4/678; 137/801; 239/445, 447, 449, 588

[56] References Cited

U.S. PATENT DOCUMENTS

| | | | |
|---|---|---|---|
| 824,454 | 6/1906 | Vanderman | 239/588 X |
| 865,355 | 9/1907 | Callmann et al. | 239/588 |
| 2,971,520 | 2/1961 | Motis et al. | 239/588 X |
| 3,722,798 | 3/1973 | Bletcher et al. | 239/445 X |
| 4,964,573 | 10/1990 | Lipski | 239/588 X |
| 5,073,991 | 12/1991 | Marty | 137/801 X |
| 5,079,781 | 1/1992 | Gnauert et al. | 137/218 X |
| 5,145,114 | 9/1992 | Monch | 239/447 X |
| 5,158,234 | 10/1992 | Magnenat et al. | 239/447 X |
| 5,356,078 | 10/1994 | Bischoff | 239/447 |
| 5,575,424 | 11/1996 | Fleischmann | 4/677 X |

FOREIGN PATENT DOCUMENTS

| | | |
|---|---|---|
| B 12 47 972 | 8/1967 | Germany . |
| A 19 56 579 | 5/1971 | Germany . |
| A 21 61 762 | 6/1973 | Germany . |
| A 33 44 614 | 6/1985 | Germany . |
| U 88 12 525 | 3/1990 | Germany . |
| A 39 08 009 | 9/1990 | Germany . |

*Primary Examiner*—Gerald A. Michalsky
*Attorney, Agent, or Firm*—Herbert Dubno; Andrew Wilford

[57] ABSTRACT

A faucet has a base provided with a valve for supplying water under pressure and a tubular U-shaped spout having an inner end pivotal in the base and an opposite downwardly directed outer end forming a downwardly open seat. A hose has an inner end connected in the base to the water-supply valve, an intermediate portion extending through the tubular spout, and an outer end carrying an end fitting formed with a rearwardly directed abutment and fittable in the seat of the spout in a seated position with the abutment engaged against the spout outer end.

16 Claims, 4 Drawing Sheets

FIG. 1
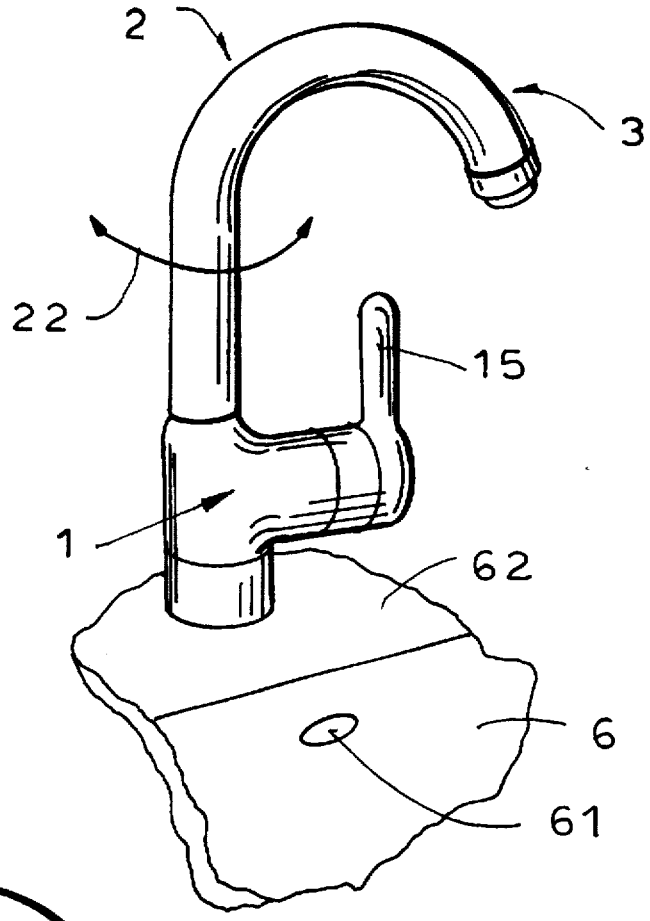
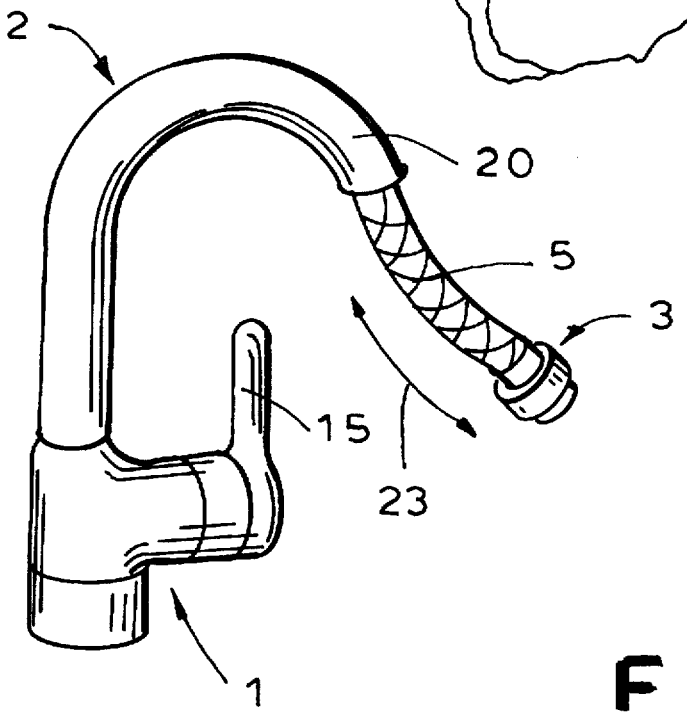
FIG. 2

HOSE-TYPE PULL-OUT FAUCET

FIELD OF THE INVENTION

The present invention relates to a pull-out faucet. More particularly this invention concerns such a faucet having a hose-mounted pull-out head.

BACKGROUND OF THE INVENTION

A standard hose-type pull-out faucet such as described in German patent document 3,135,860 filed 24 Mar. 1983 by A. Gottwald and W. Koster has a base provided with a valve for supplying water under pressure and a tubular spout having an inner end pivotal in the base and an opposite outer end. A hose has an inner end connected in the base to the water-supply valve, an intermediate portion extending through the tubular spout, and an outer end. An end fitting on the hose outer end can be fitted over the spout outer end and is normally generally L-shaped so its outlet end can be directed downward.

Such an assembly can be used like a standard faucet, in which case the fitting sits on the outer end of the spout with its output directed downward. The fitting can also be pulled from the spout to allow the flow to be directed by the user, for instance to clean out the sink underneath the faucet or spray the head of someone getting a shampoo.

Such a faucet is fairly complex to manufacture and often has an unattractive hybrid appearance. It further does not readily meet all possible uses, for instance cannot be employed to fill an overlarge container unless the user holds it.

OBJECTS OF THE INVENTION

It is therefore an object of the present invention to provide an improved hose-type pull-out faucet.

Another object is the provision of such an improved hose-type pull-out faucet which overcomes the above-given disadvantages, that is which is of relatively simple construction while having an attractive simple appearance.

A further object is to provide such a faucet which can be used hands-free to fill a large container.

SUMMARY OF THE INVENTION

A faucet has according to the invention a base provided with a valve for supplying water under pressure and a tubular U-shaped spout having an inner end pivotal in the base and an opposite downwardly directed outer end forming a downwardly open seat. A hose has an inner end connected in the base to the water-supply valve, an intermediate portion extending through the tubular spout, and an outer end carrying an end fitting formed with a rearwardly directed abutment and fittable in the seat of the spout in a seated position with the abutment engaged against the spout outer end.

This arrangement is extremely simple. It resembles a conventional goose-neck faucet during normal use, without an ungainly fitting on the end of the spout. When the fitting is pulled out of the spout, however, one gains all the advantages of a pull-out hose-type faucet. The end fitting is relatively small so it can be made inexpensively, considerably reducing the cost of the faucet.

According to the invention the base is formed with an upwardly open seat and the spout inner end is formed with an extension removably engageable and pivotal in the seat of the base. This extension is tubular, surrounds the tube, and is formed with a radially outwardly open groove fittable with retaining structure in the base. Furthermore the base has a tubular upper part of a predetermined outside diameter and the tube inner end is of a diameter equal to that of the base upper part. The spout inner leg is generally vertical and the spout outer leg forms at its outer end an angle of between 20° and 45° to the vertical. Thus the entire spout can be pulled out of the base. This is particular handy in filling a large vessel in that the spout can be hooked over the edge of such a vessel and left to fill it unattended. Alternately the upstanding spout can easily be moved out of the way to gain access to something behind the faucet, for instance a window.

The outer spout end in accordance with the invention is generally cylindrical and of predetermined outer diameter. The fitting has an outwardly projecting annular ridge of an outer diameter substantially greater than the outer diameter of the outer spout end. Thus it is easy to pull the fitting out of the spout.

The fitting is formed according to the invention with a central single large-diameter outlet hole and with an array of small-diameter outlet holes and is provided with a valve for directing flow from the hose alternately to the large hole and to the small holes. This body can be slidable and formed with a throughgoing flow-diverting port. The sliding motion can actually be rotation in which case the fitting includes an upstream part formed with an upstream passage receiving water from the hole and a downstream part formed with a pair of downstream passages one of which leads to the large outlet hole and the other of which leads to the small outlet holes. The valve body is provided between the parts and the part is movable on pivoting of the body between a position aligned between the upstream passage and one of the downstream passages and another position aligned between the upstream passage and the other of the downstream passages. The large hole is provided with an aerator and the small holes are in an array surrounding the large hole.

Since the fitting can be separated from the faucet and actually immersed in a body of dirty water, it is provided with a backflow preventer. To this end the fitting has a rearwardly extending projection joined to the hose outer end and holding the preventer. The projection and outer end seat are complementarily tapered.

In another arrangement according to the invention the fitting has an inner tubular part joined to the hose and, spaced outwardly from the inner part, an outer sleeve. The fitting is centered on an axis and has an outlet opening at between 10° and 35°, preferably 30°, to the vertical.

BRIEF DESCRIPTION OF THE DRAWING

The above and other objects, features, and advantages will become more readily apparent from the following description, reference being made to the accompanying drawing in which:

FIG. 1 is a small-scale perspective view of the faucet according to the invention;

FIG. 2 is a view like FIG. 1 but with the hose extended;

SPECIFIC DESCRIPTION

Figure 3:
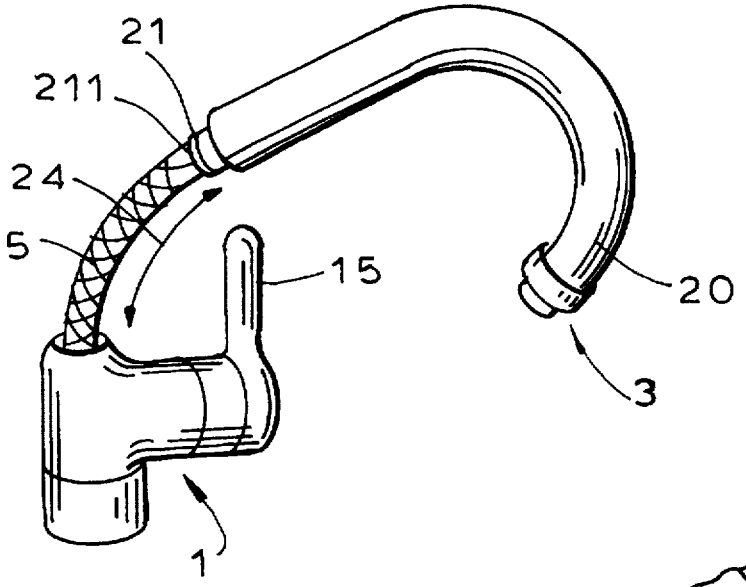
FIG. 3 is a view like FIG. 1 but with the hose and faucet end extended.

As seen in FIGS. 1 through 4, a faucet according to the invention has a base 1 mounted on a counter 62 in front of a sink 6 having an overflow hole 61. The base 1 is provided with a single-lever valve 15 that receives hot and cold water from unillustrated under-counter supply lines and feeds this water, at a temperature and volume determined by the position of its single handle, to an output line that extends back down through the single-hole mount.

A U-shaped spout tube 2 has a vertical leg with a downward tubular extension 21 that fits in a complementary seat in the base 1 for pivoting of the spout 2 about a vertical axis as shown by arrow 22. This extension 21 has an outwardly open groove 211 into which can fit an unillustrated spring-loaded ball in the base 1 to releasably retain the spout tube 2 in position on the base 1 while permitting it to pivot. A hose 5 has an unillustrated inner end connected under the counter 62 to the output line of the valve 15 and extends up through the base 1 and spout 2 to an outer end 20 of the spout 2 where it carries a fitting 3. This outer end 20 extends at about 165° to the vertical and is directed downward into the sink 61. As shown in FIG. 2 the fitting 3 can be pulled as shown by arrow 23 out of the spout 2 for use as a small hand sprayer.

In addition FIG. 3 shows how it is possible to pull the entire spout 2 as shown by arrow 24 out of the base 1. This is particularly convenient if one needs to fill a large bucket that is too tall to fit in the sink 6 underneath the spout 2, as the spout 2 can be simply hooked over the edge of the bucket and left there as it fills. Furthermore if the faucet is mounted in front of a window, which is common, it is possible to move the entire spout 2 out of the way to gain access to the window or allow the window to pivot in.

Figure 4:
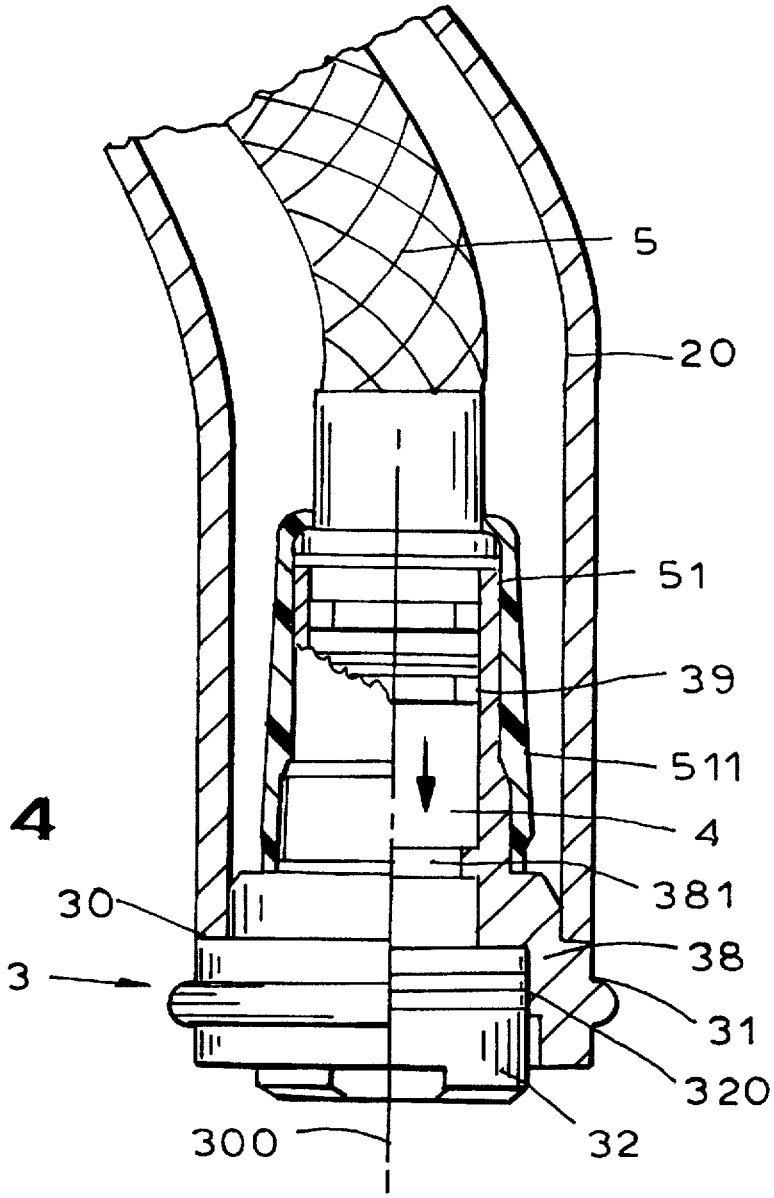
FIG. 4 is a large-scale sectional view of a detail of FIG. 1.

As shown in FIG. 4 the fitting 3 comprises an outer nut 51 engaged around the end of the hose 5 and an inner part 38 fitted therein. An outer surface 511 of the nut 51 is tapered so that the fitting 3 can slide easily back into the complementarily shaped spout 2. An abutment rim 31 on the fitting 30 engages flatly against the spout end 20. Inside the part 38 is a standard backflow preventer 4 that ensures that, if the fitting 3 is immersed in a body of water and pressure in the supply lines is momentarily reversed, the fixture will not suck up the water. In addition the fitting 3 is formed with a radially outwardly projecting ridge 31 that allows it to be held and grabbed easily as it is of larger outside diameter than the spout 20. Coaxially to a central axis 300 of the fitting 3 is an opening 381 that is aligned with an outlet opening 32 into which is threaded a standard flow aerator 320.

Figure 5:
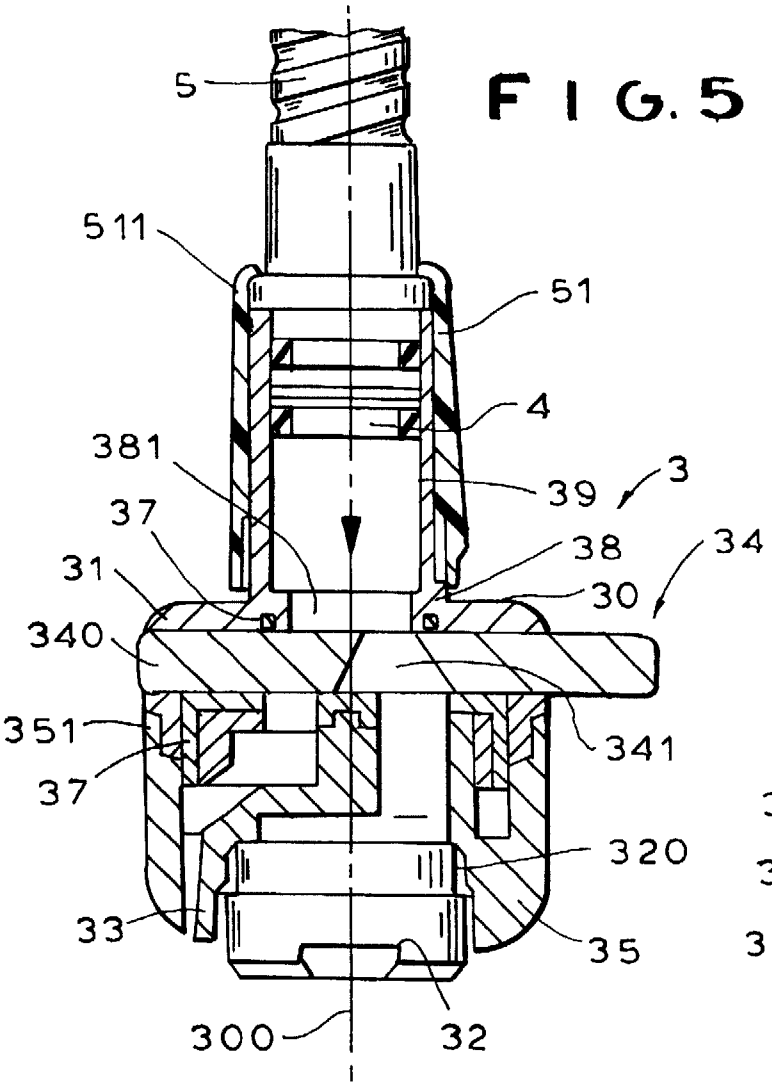

FIG. 5 shows another arrangement where a valve 34 comprised of a slidable valve body 340 with a throughgoing hole 341 is provided to switch input from an input opening 318 to the aerator 320 or to a circular array of small-diameter holes 33. To this end the fitting has a front part 35 and a rear part 31 joined at a weld 351 with a seal 37 between these parts 31 and 35. The hole 341 is flared so that at any time it opens into one or the other of the outlet passages so it cannot block flow through the fitting 3 and create a dangerous high pressure in the hose 5.

Figure 6:
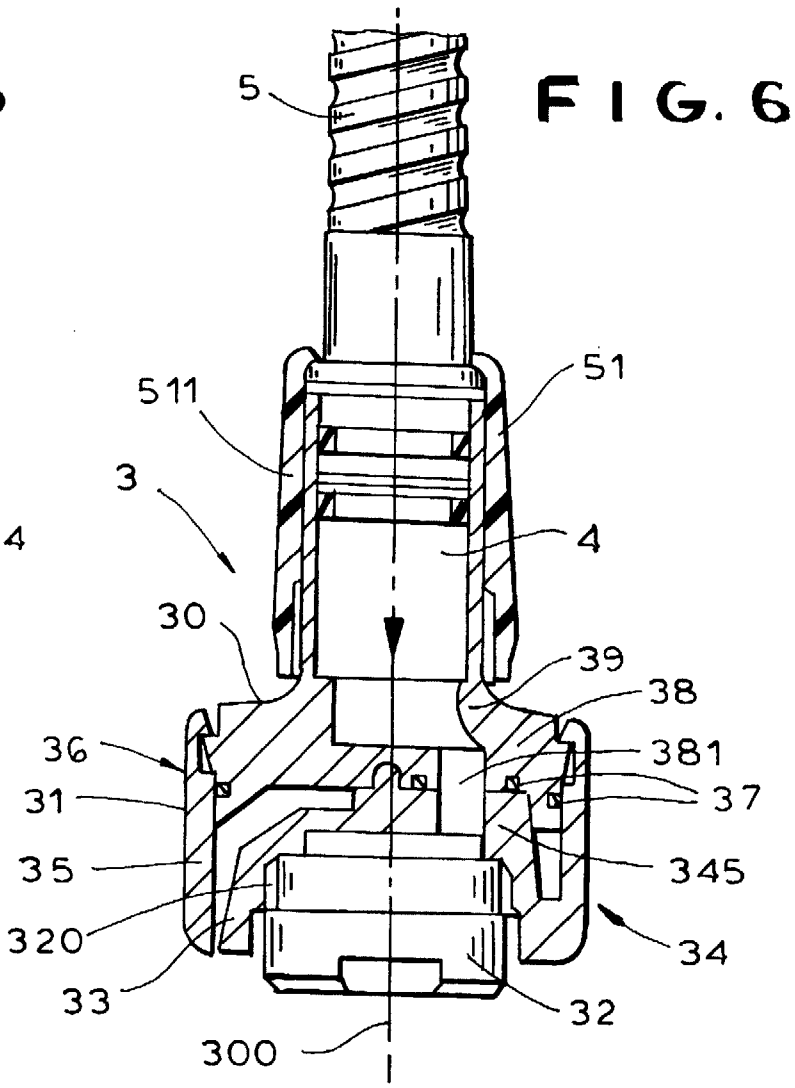
FIGS. 5 and 6 are views like FIG. 4 of alternative arrangements according to the invention.

The arrangement of FIG. 6 is similar, but has a rotary slider 345. The housing part 35 is secured by a snap connection 36 with the upstream part 38. Once again seals 37 are provided between the relatively movable parts.

Figure 7:
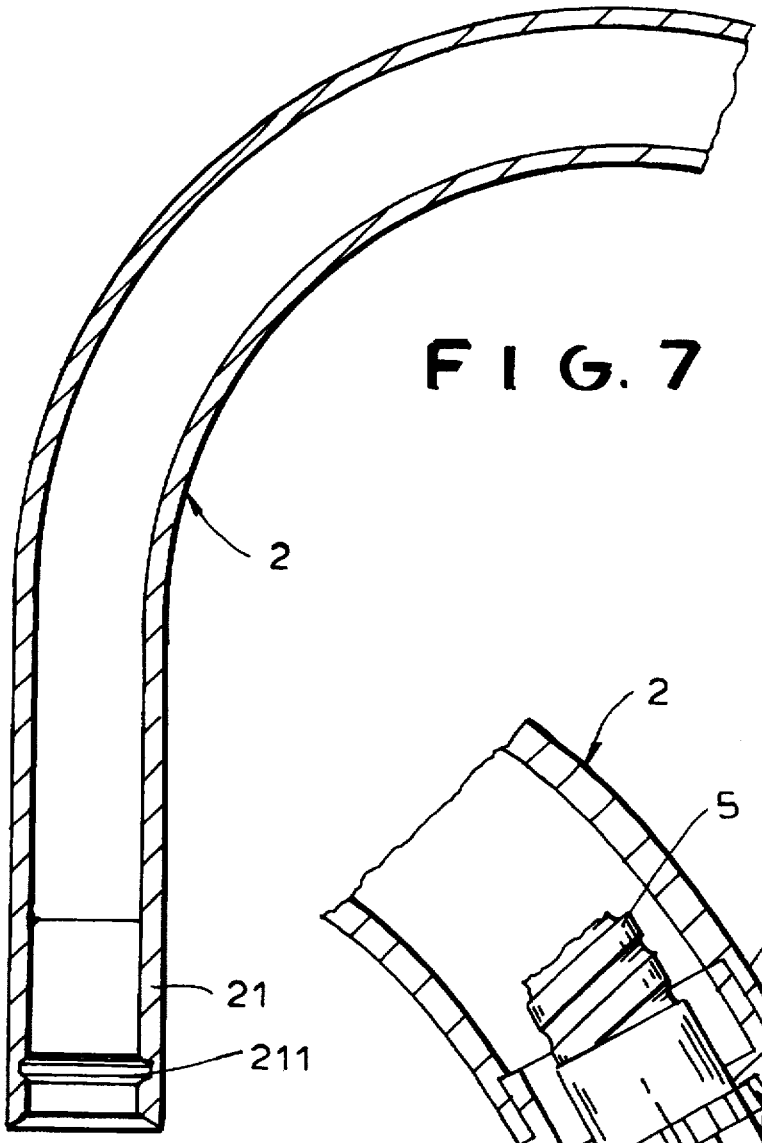
FIG. 7 is a large-scale view of a detail of the faucet spout.
Figure 8:
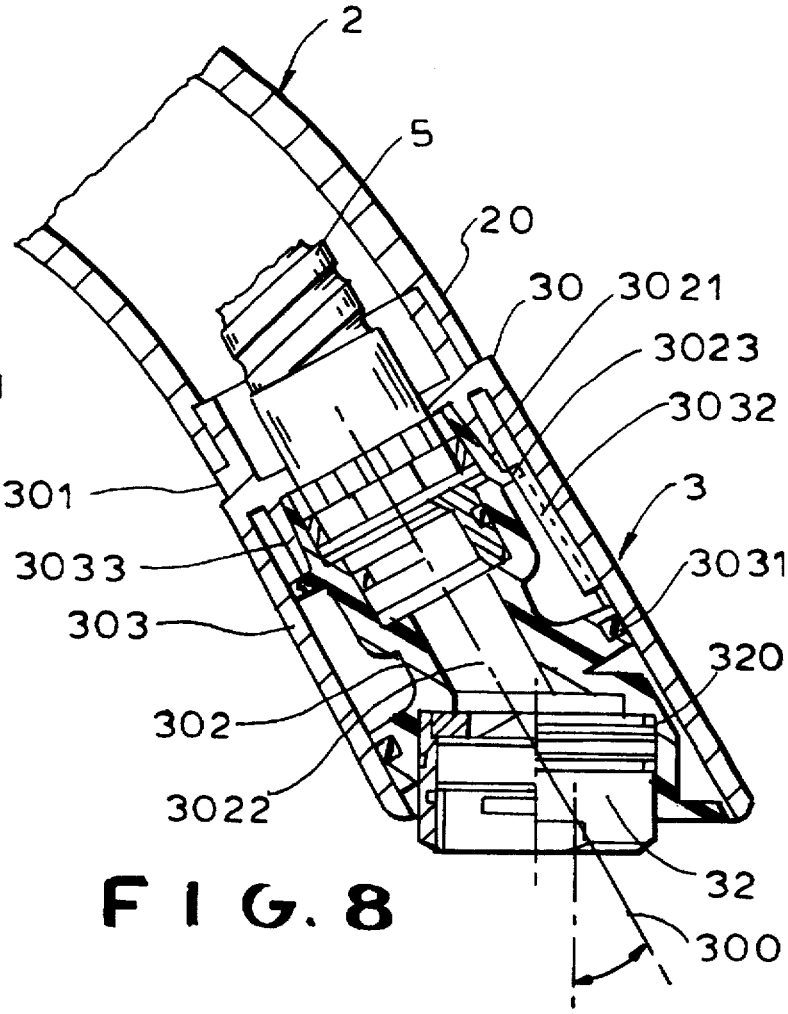
FIG. 8 is a large-scale sectional view of another head assembly according to the invention.

In FIGS. 7 and 8 the spout 2 is adapted to fit over an unillustrated vertical tube of the base 1 so that the groove 211 opens radially inward. Once again the spout 2 is U-shaped and bent here through a 150° arc with a collar 301 of the same outside diameter as the spout 20. The fitting is formed of an inside water-guiding part 302 and an outer sleeve 303 which are separated by an air space so that, even when the inner part 302 is conducting hot water the outer part 303 does not get too hot to touch. The inner part 302 is provided with a connection 3021 for the hose and with a coaxial through-flow passage 3022. The part 302 is arranged at an angle 321 of about 30° to the axis 300 so that it faces directly vertically downward.

The outer sleeve part 303 is axially held in place by means of an O-ring 3031. A nose 3023 on the part 302 ensures angular coupling by fitting into an axially extending groove 3032 of the body 303. In addition when fit together the sleeve part 303 engages with an inner collar 3033 the engagement fingers of the coupling 3021 so that the entire assembly is held solidly together.

We claim:

1. A faucet comprising:

a stationary base provided with means for supplying water under pressure and formed with an upwardly open seat;

a rigid and tubular U-shaped spout having an inner end pivotal in the seat of the base about a vertical axis and an opposite downwardly directed outer end forming a downwardly open seat, the spout inner end being formed with an extension removably engageable and pivotal in the seat of the base, whereby the spout can be separated from the base;

a hose having an inner end connected in the base to the water-supply means, an intermediate portion extending through the tubular spout, and an outer end, the hose being slidable in the spout between an extended position with the hose outer end spaced from the spout outer end and a retracted position with the hose outer end fitted with the spout inner end; and an end fitting on the hose outer end, formed with a rearwardly directed abutment, and fittable in the retracted position in the seat of the spout in a seated position with the abutment engaged against the spout outer end.

2. The faucet defined in claim 1 wherein the extension is tubular, surrounds the spout, and is formed with a radially outwardly open groove fittable with retaining structure in the base.

3. The faucet defined in claim 2 wherein the base has a tubular upper part of a predetermined outside diameter and the spout inner end is of a diameter equal to that of the base upper part.

4. The faucet defined in claim 1 wherein the spout inner end is generally vertical and the spout outer end forms at its outer end an angle of between 20° and 45° to the vertical.

5. The faucet defined in claim 1 wherein the outer spout end is generally cylindrical and of predetermined outer diameter, the fitting having an outwardly projecting annular ridge of an outer diameter substantially greater than the outer diameter of the outer spout end.

6. The faucet defined in claim 1 wherein the fitting is formed with a central single large-diameter outlet hole and with an array of small-diameter outlet holes and is provided with valve means for directing flow from the hose alternately to the large hole and to the small holes.

7. The faucet defined in claim 6 wherein the valve means of the fitting includes a slidable valve body formed with a throughgoing flow-diverting port.

8. The faucet defined in claim 6 wherein the valve means of the fitting includes a valve body that is rotatable in the fitting.

9. The faucet defined in claim 8 wherein the fitting includes an upstream part formed with an upstream passage receiving water from the hole; and a downstream part formed with a pair of downstream passages one of which leads to the large outlet hole and the other of which leads to the small outlet holes, the valve body being provided between the parts and having a port movable on pivoting of the body between a position aligned between the upstream passage and one of the downstream passages and another position aligned between the upstream passage and the other of the downstream passages.

10. The faucet defined in claim 6 wherein the large hole is provided with an aerator.

11. The faucet defined in claim 6 wherein the small holes are in an array surrounding the large hole.

12. The faucet defined in claim 1 wherein the fitting is provided with a backflow preventer.

13. The faucet defined in claim 12 wherein the fitting has a rearwardly extending projection joined to the hose outer end and holding the preventer.

14. The faucet defined in claim 13 wherein the projection and outer end seat are complementarily tapered.

15. The faucet defined in claim 1 wherein the fitting has an inner tubular part joined to the hose and, spaced outwardly from the inner part, an outer sleeve.

16. The faucet defined in claim 1 wherein the fitting is centered on an axis and has an outlet opening at between 10° and 35° to the axis.

* * * * *